United States Patent [19]

Nigg

[11] 4,111,515

[45] Sep. 5, 1978

[54] LAMP HOLDER FOR TWIN-SOCKET TYPE HALOGEN LAMPS

[76] Inventor: Jurg Nigg, Beckenhofstrasse 30, 8006 Zurich, Switzerland

[21] Appl. No.: 720,322

[22] Filed: Sep. 3, 1976

[30] Foreign Application Priority Data

Sep. 12, 1975 [CH] Switzerland ..... 11861/75

[51] Int. Cl.[2] ..... H01R 13/00

[52] U.S. Cl. ..... 339/112 R; 339/17 D; 339/31 L; 339/154 L; 339/278 L

[58] Field of Search ..... 339/112 R, 1 L, 17 D, 339/31 L, 59 L, 61 L, 74 L, 91 L, 93 L, 94 L, 97 L, 99 L, 102 L, 108 L, 110 L, 154 L, 278 C

[56] References Cited

U.S. PATENT DOCUMENTS

| | | | |
|---|---|---|---|
| 1,753,117 | 4/1930 | Hosking | 339/154 L X |
| 3,456,233 | 7/1969 | Bustamante | 339/154 L |
| 3,648,355 | 3/1972 | Shida et al. | 339/278 C X |
| 3,853,382 | 12/1974 | Lazar | 339/278 C X |

*Primary Examiner*—Roy Lake
*Assistant Examiner*—DeWalden W. Jones
*Attorney, Agent, or Firm*—Lawrence Rosen; E. Janet Berry

[57] ABSTRACT

A lamp holder comprising a ceramic body provided with a socket containing a contact point composed of a major amount of silver and a minor amount of nickel. The lamp holder is especially suitable for use with twin-socket halogen lamps.

13 Claims, 1 Drawing Figure

LAMP HOLDER FOR TWIN-SOCKET TYPE HALOGEN LAMPS

Figure 1:
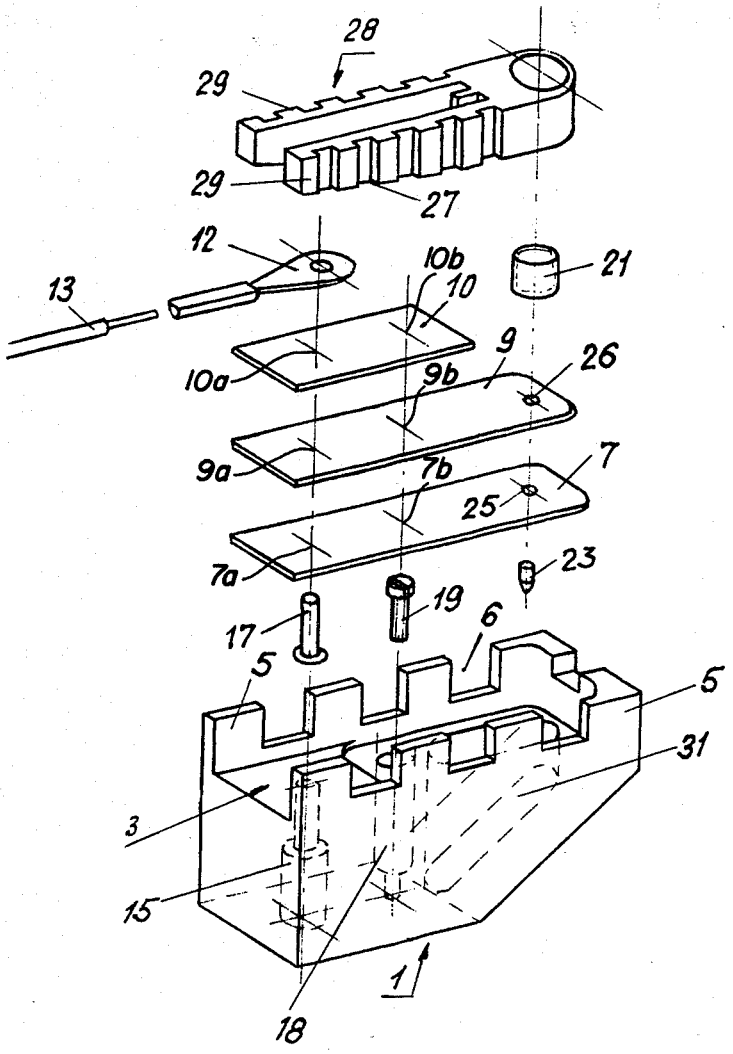

The present invention relates to a lamp fixture, especially for twin-socket type halogen lamps.

It has been quite evident that the hitherto used types of lamp fixture have often led to considerable malfunctioning of the lamps as well as the sockets thereby considerably shortening the service life of the lamp. Excessive temperatures at the points of contact and at the ceramic end of the lamps often were the cause of said malfunctions. As a result of such overheating, the fuse built into the lamp usually was also overloaded, and in many cases it was not only the fuse that melted. Moreover, excessive temperatures often resulted in a burning out of the contact surfaces of the socket and the lamps.

According to European recommendations the normal biasing force should amount to 2 kp (kilopond). As a consequence of excessive temperature, said contact pressure will diminish to 0, a fact which may lead to sparking and excessive flow resistance. As a consequence of the oxidation process, non-conductive transition zones are formed which further increase the resistance and will result in the melting down of the socket's contact point.

The present invention is intended to provide a socket which will do away with the aforesaid defects and thereby guarantee an extended service life for the fixtures. Accordingly, the lamp holder of this invention has at least one ceramic body in which, as contactors for the lamp sockets, there are contact knobs or buttons composed mainly of silver and containing nickel.

An embodiment of the subject-matter of the invention is subsequently explained by means of the accompanying drawings in which:

The FIGURE shows the structure of a lamp holder in perspective, exploded view.

A lamp holder socket 1 has a shower recess 3 enclosed on three sides by a supporting bead 5 with a plurality of notched openings 6. Furthermore, the lamp holder has a contact disc 7 as well as a larger spring contact 9 and a small spring contact 10. The supply of electrical current is effected via terminal 12 which is supplied by means of a feed strand 13. An opening or stepped bore 15 accommodates a rivet 17, while another orifice or stepped bore 18 has been provided for the purpose of accommodating a cylindrical screw 19. Furthermore, a sleeve 21 has been arranged in a fixed position as well as a contact knob 23 which penetrates the contact springs 7 and 9, respectively through one passage 25 and 26 each. The recess 3 has been designed to accommodate a cooling insert 28 having cooling fins 29. The lamp is inserted through a recess 31 into which the lamp socket is introduced.

If it is a problem of holding twin-socket lamps, e.g., halogen lamps, two sockets of the above described type will become necessary.

Socket holder 1 consists of ceramic material. The rivet 17, e.g. of brass, penetrates the orifice 15 and penetrates the contact springs 7, 9, and 10 at *7a*, *9a* and *10a*, respectively, so as to connect the springs 7, 9 and 10 with the terminal 12 whereby the riveted structure is simultaneously held in place by the rivet in socket 1.

The three contact springs 7, 9, and 10 have also been perforated at *7b*, *9b* and *10b*, respectively in such a way so as to permit access to the screw 19 that is designed to hold in place socket 1, e.g., on an angle bracket. Such access permits the screw to be turned by means of a screwdriver.

On the other hand, the contact knob 23 is riveted to the contact springs 7 and 9 and also with the cooling insert 28 and the sleeve 21. In order to guarantee satisfactory biasing pressure on the contact knob 23, the side 27 pointing towards the socket 1 of the cooling insert 28 has a convexly curved, as shown by its rounded shape in the drawing, with the curvature being around an axis transverse to the length of the cooling insert. Lamp holders of that type are designed to accommodate high-output lamps in the category of 2 kw and more.

The contact knob 23 having a conical free end has been designed in such a way as to bar the passage of any ions. Normally it consists of two metals joined by a sintering process, preferably silver and nickel, and preferably in amounts of 90 to 10 percent by weight, respectively. By using nickel which serves as a barrier against copper ions, any diffusion between the lamps and the socket contact is avoided.

As a consequence of the possibly very high temperatures (above 300° C.), the use of a cooling insert 28 of aluminum with cooling fins 29 has proven very important as far as the service life of the lamp is concerned. It permits the reduction of the conventional temperature by approximately 100° C. at the most critical point in the circuit where very high loads must be sustained, namely at the contact knob 23, thus applying temperatures of approximately 200° C. instead of the conventional 300° C.

The current bridge between the contact knob 23 and the feed strand 13 is effected via spring contact 7 and spring contacts 9 and 10, whereby strip material has shown excellent properties.

The two spring contacts 9 and 10 having different sizes consist of non-oxidizable, temperature resistant spring material. These two flat spring contacts 9 and 10 serve to bias the contact knob 23 towards the corresponding contact point of the lamp socket with a uniform force.

The holder 1 is a ceramic body into which the metallic parts have been introduced, e.g. riveted. It has been designed in such a way that there is complete protection against any contact from the side from where the socket is accessible. Furthermore, the holder has been dimensioned in such a way as to accept conventional socket elements in said holder, thereby permitting said holder to be used in exchange for older holders.

It has been demonstrated in various experiments that it is more advantageous to select a smaller, however more dependably functioning contact surface between the socket and the lamp holder. This is ensured by the conical shape of the contact knob 23 with its relatively small frontal contact surface thereby providing the latter with the necessary contact area and by safeguarding the corresponding load per unit surface at the corresponding passage of current (amperage) whereby, on the other hand, the flow of current can never be barred by any insufficient contacts. If large contact surfaces are used for contact knobs, satisfactory bias and contact cannot be guaranteed, so that the passage of current will exceed the specific value and will result in an additional heating of the end of the lamp and the socket.

The conductor 13 has been designed as a multiple-strand copper flex wire, wherein the Teflon sheathing is again coated by means of a siliconized glass texture. Tests have shown that cables solely sheathed by glass texture will tend to form cracks in the sheathing after prolonged use. The cable terminal 12 and the holding rivet 17 have been manufactured from material able to withstand an operating temperature of 250° C. without difficulty, e.g. brass.

Mounting the socket or holder socket respectively should be accomplished with the greatest care in order to adhere to the prescribed contact pressure; otherwise the lamp sockets and the lamps will be destroyed much faster. Therefore the contact pressure of the contact knob 23 on the lamp socket must be approximately 2 kp.

The holder socket 1 or the recess 3 of said socket, respectively is easily accessible from one side. This will facilitate the introduction of the cable body. At the same time, however, any contact with current carrying parts is not possible, even from the side. The set screw 19 preferably consists of chromium steel, because brass screws, at such high temperatures, will corrode and will resist loosening after use.

What is claimed is:

1. A lamp holder, comprising socket means for receiving and holding a part of a lamp and contact means for electrically contacting the lamp;

said contact means comprising a contacting knob engageable with a lamp conductor held in said socket means; said knob consisting of a material consisting mainly of silver and the remainder of a minor portion of nickel; terminal means electrically connected to said contacting knob;

said socket means being comprised of ceramic material; said socket means supporting said contacting knob and a lamp conductor.

2. A lamp holder according to claim 1 wherein said contacting knob has a conical tip that is engageable with a lamp conductor.

3. The lamp holder according to claim 1, wherein said contacting knob consists of a sintered mixture of about 90% by weight of silver and about 10% by weight of nickel.

4. The lamp holder according to claim 1, further comprising a rivet for engaging said contact means and for mounting it to said socket means.

5. A lamp holder, comprising socket means for receiving and holding a part of a lamp and contact means for electrically contacting the lamp;

said contact means comprising a contacting knob engageable with a lamp conductor held in said socket means; said knob being comprised of a material containing mainly silver and a minor portion of nickel; terminal means electrically connected to said contacting knob;

said contact means further comprising a strip of corrosion resistant material carrying said contacting knob and forming a conductor between said contacting knob and said terminal means;

said socket means being comprised of ceramic material; said socket means supporting said contacting knob and a lamp conductor.

6. The lamp holder according to claim 5, wherein there are a plurality of said strips of corrosion resistant material, at least one of which carries said contacting knob; said strips being overlaid upon each other and being in mechanical and electrical contact; said strips forming said conductor between said contacting knob and said terminal means.

7. The lamp holder according to claim 6, wherein said strips are at least partly comprised of spring steel material and are biased to urge said contacting knob toward a lamp conductor then in said socket means.

8. The lamp holder according to claim 7, further comprising a chromium steel screw for mounting said socket means to another object.

9. The lamp holder according to claim 7, further comprising said socket means including a support recess; a cooling insert having metallic fins and located in said recess and over said strips and in thermal contact with said strips for cooling same.

10. The lamp holder according to claim 9, wherein said cooling insert has a convexly shaped side, curved around an axis extending across said insert, and pointing towards said strips to allow that said side to bias said strips.

11. The lamp holder according to claim 10, wherein the contacting knob projects from one side of said strips and said insert is at the other side of said strips.

12. A lamp holder, comprising socket means for receiving and holding a part of a lamp and contact means for electrically contacting the lamp;

said contact means comprising a contacting knob engageable with a lamp conductor held in said socket means; said knob being comprised of a material containing mainly silver and a minor portion of nickel; terminal means electrically connected to said contacting knob;

said socket means being comprised of ceramic material; said socket means supporting said contacting knob and a lamp conductor;

a cooling insert separate from said contact means and engageable into thermal contact with said contact means for cooling said contact means.

13. The lamp holder according to claim 12, further comprising said socket means including a support recess; said cooling insert having metallic fins and being located in said recess.

* * * * *